US006877585B2

(12) United States Patent
Tinianov

(10) Patent No.: US 6,877,585 B2
(45) Date of Patent: Apr. 12, 2005

(54) ACOUSTICAL CEILING TILES

(75) Inventor: Brandon Dillan Tinianov, Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 335 days.

(21) Appl. No.: 09/845,791

(22) Filed: Apr. 30, 2001

(65) Prior Publication Data

US 2002/0029929 A1 Mar. 14, 2002

Related U.S. Application Data

(60) Provisional application No. 60/203,926, filed on May 12, 2000.

(51) Int. Cl.[7] ..... E04B 1/82; E04B 2/02

(52) U.S. Cl. ..... 181/290; 181/286; 181/292; 181/294; 181/295; 52/145

(58) Field of Search ..... 181/284–294, 181/33; 52/145, 144, 384; 174/151; 428/130–138, 43, 63, 116, 49, 119

(56) References Cited

U.S. PATENT DOCUMENTS 3,858,676 A * 1/1975 Le Masurier ..... 181/286
5,683,278 A 11/1997 Pietsch et al.
5,824,973 A * 10/1998 Haines et al. ..... 181/286
6,182,787 B1 * 2/2001 Kraft et al. ..... 181/292

FOREIGN PATENT DOCUMENTS

GB 2118590 11/1983

* cited by examiner

*Primary Examiner*—David Martin
*Assistant Examiner*—Renata McCloud
(74) *Attorney, Agent, or Firm*—Robert D. Touslee

(57) ABSTRACT

A system for improved sound absorption, including a substrate of porous insulation material and of a first air flow resistance, and a facing material attached to the substrate and of a second air flow resistance, wherein a total system resistance is a combination of the first and second air flow resistances, and wherein the total system resistance and the second air flow resistance are of relatively low values.

5 Claims, 4 Drawing Sheets

Model of Optimized Ceiling System

ACOUSTICAL CEILING TILES

This application claims the benefit of Provisional Application No. 60/203,926 filed May 12, 2000.

BACKGROUND OF THE INVENTION

1. Field of the Invention

The present invention relates generally to sound control systems and more particularly to the acoustical performance of faced ceiling systems.

2. Background Information

In modern structures, such as residential or commercial buildings, an important issue for a designer to consider is the adequacy of sound absorption in interior rooms. Sound absorption can be defined as the total energy of incident sound minus that of reflected sound, and the amount of sound absorption provided by elements in a room (such as carpeting, furniture, etc.) can greatly affect an occupant's acoustic comfort level. For example, in a room or space that allows excessive echo or reverberation (i.e., persistence of sound after the sound source has stopped producing sound), speech comprehension can be difficult if not impossible.

The ability of a material or system for absorbing sound can be expressed in units of Noise Reduction Coefficient or NRC, as described by the American Society of Testing and Materials (ASTM), where a system of 0.90 NRC has about 90% absorbing ability of an ideal absorber, for example. NRC ratings are calculated for a system by averaging determined sound absorption coefficients specified at ⅓ octave band center frequencies of 250, 500, 1000, and 2500 Hz.

Reverberation time is a unit for measuring echo in a space and indicates the period of time required for a sound level to decrease 60 decibels after the sound source has stopped. The amount of sound absorption necessary for a particular space depends, of course, on the primary uses of the space. For spaces where a reduction in reverberation time is critical (such as large meeting rooms, dining areas, auditoriums, or teleconferencing rooms), sound absorption areas and locations are adjusted to achieve the reverberation time that suits the room use by strategically distributing prescribed sound absorbing panels and tiles over the walls, ceiling, and possibly the floor. Such a treatment enhances intelligibility and sound diffusion in the room and, in many cases, the use of sound absorbing panels optimized for sound absorption in the speech frequencies (around 250 to 2,000 Hz), can provide a satisfactory reverberation time and preserve necessary signal-to-noise ratios without amplification.

For spaces where factors other than sound control dominate the design, such as rooms in an office building, ceiling tiles are typically utilized as the only major sound absorbing elements. While these conventional tiles possess some sound absorbing ability (e.g., an NRC rating of 0.55), designers are sometimes forced to use further acoustical insulation in the forms of batting installed above ceiling tiles or additional ceiling and/or wall sound panels to reduce distracting noises associated with human conversation and office equipment, and to increase employee privacy and productivity. Unfortunately, these methods are expensive, attach additional bulk to a structure's design, and require time-consuming and accurate installation.

Ceiling tiles are typically covered on their interior side (i.e., the side facing occupants of a room) with a facing material that has the sole purpose of making the tiles aesthetically pleasing or at least unobtrusive. To date, such facing material has not been addressed as an important element of an acoustical system.

A method of superimposing a facing sheet with a substrate to augment the acoustical properties of the substrate is disclosed in U.S. Pat. No. 5,824,973 (Haines et al.), hereby incorporated by reference in its entirety. The Haines patent, however, requires a complicated and particularized determination of each substrate's optimized value of acoustic resistance ratio, where a facing material of a calculated air flow resistance is only superimposed on a substrate if it is determined that the substrate has an insufficient air flow resistance to optimize the value of the acoustic resistance ratio.

SUMMARY OF THE INVENTION

Accordingly, the present invention is directed to a simple and inexpensive ceiling system that improves upon existing ceiling tiles designs to improve broadband acoustical performance in the form of absorption.

According to an exemplary embodiment of the present invention, a system for improved sound absorption is provided, including a substrate of porous insulation material and of a first air flow resistance, and a facing material attached to the substrate and of a second air flow resistance, wherein a total system resistance is a combination of the first and second air flow resistances, and wherein the total system resistance and the second air flow resistance are of relatively low values.

The current design recommends a low (in terms of typical practice), rather than high facing flow resistance. In addition, this current invention indicates specific ranges of flow resistances for each system element and the frequency range these elements effect.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1:
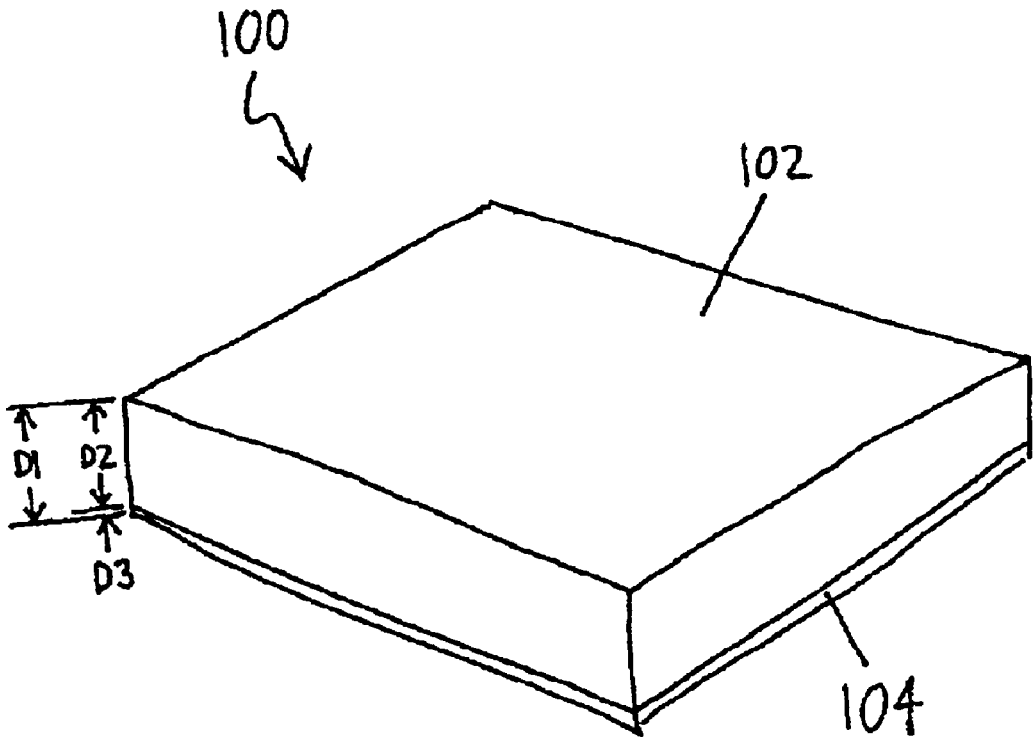
FIG. 1 is a perspective view of a tile system in accordance with an exemplary embodiment of the present invention.

FIG. 1 illustrates a system for sound absorption, represented by tile system 100, which includes substrate 102 and facer or facing material 104 attached to substrate 102. Substrate 102 is of a first air flow resistance and facing material 104 is of a second air flow resistance, where a total system resistance is a combination of the first and second air flow resistances. Tile system 100 can be used as one element in an array of similar elements (e.g., an array of ceiling tiles) or can be used alone. Also, tile system 100 can be included in a ceiling assembly or any other structural assembly. Substrate 102 can be made of any conventional ceiling tile material, or can alternatively be made of any porous insulation material, such as glass fiber, mineral fiber, thermoplastic polymeric fiber, thermosetting polymeric fiber, carbonaceous fiber, milkweed fiber, or foam insulation, for example. Facing material 104 can be a thin skin made of plastic, or can alternatively be made of any thin, coated or uncoated, material, such as semi-porous paper, fabric, or perforated film. Tile system 100 is shown as a square or rectangular shape, but can alternatively be of any shape.

The thickness D2 of substrate 102 can be of a conventional value, such as one inch, or can alternatively be larger or smaller. The thickness D3 of facing material can be as thin as around 0.010 inches, or can alternatively be larger or smaller.

Facing material 104 can be adhered to one major side of substrate 102 by, for example, adhesive bonding or thermal bonding. Facing material 104 can alternatively be secured to or maintained in place on substrate 102 by other means, including but not limited to, mechanical fasteners adhering, bonding, or otherwise securing the facing material 104 to substrate 102 along the edges or sides of substrate 102 or by otherwise directly or indirectly securing facing material 104 to substrate 102. As another alternative, substrate 102 may be manufacture along with facing material 104 as a single laminate structure. Facing material 104 can also be attached to both major sides of substrate 102 (for example, a second facing material can be attached on the opposite side of facing material 104).

Placement of tile system 100 in a structure (such as a commercial building) can be in a conventional fashion, for example, suspended in a grid below floor assemblies at a distance of around 402 mm to create an air plenum for acoustical purposes. Because the size of tile system 100 does not differ from conventional ceiling tiles (or differs only slightly), the installation of tile system 100 does not require any additional steps or training. Tile system 100 can alternatively be positioned in any other conventional or other configuration.

Unlike the Haines patent, an exemplary embodiment of the present invention recommends a low (in terms of typical practice), rather than high, facing flow resistance. In addition, an exemplary embodiment of the present invention indicates specific ranges of flow resistances for each system element and the frequency range these elements effect. The acoustical performance of tile system 100 can be separated into three frequency regions of interest controlled by two different physical parameters: total system air flow resistance (or simply total system resistance) and the air flow resistance of facing material 104, both measured in units of meters-kilograms-second (MKS) Rayls. Rayls can also be expressed as the drag coefficient of air through a material or system. The total system resistance of tile system 100 is the combined resistances of substrate 102 and facing material 104.

The total system resistance controls the low frequency region, from around 100 to 400 Hz. This is due to the fact that the wavelengths in this region are much greater (e.g., by four times or more) than the total tile thickness D1 and therefore see tile system 100 as a lumped, resistive element. The second region is the high frequency range of around 1250 to 8000 Hz. Within this region, the resistance of facing material 104 controls the performance. Here, the thickness of tile system 100 is large with respect to the wavelength (e.g., greater than ¼ wavelength or more), and the sound wave accordingly perceives tile system 100 as multiple discrete elements (i.e., substrate 102 and facing material 104). The third and final zone is the transition zone of middle frequencies from around 400 to 1250 Hz where the performance is effected by both parameters.

Figure 2:
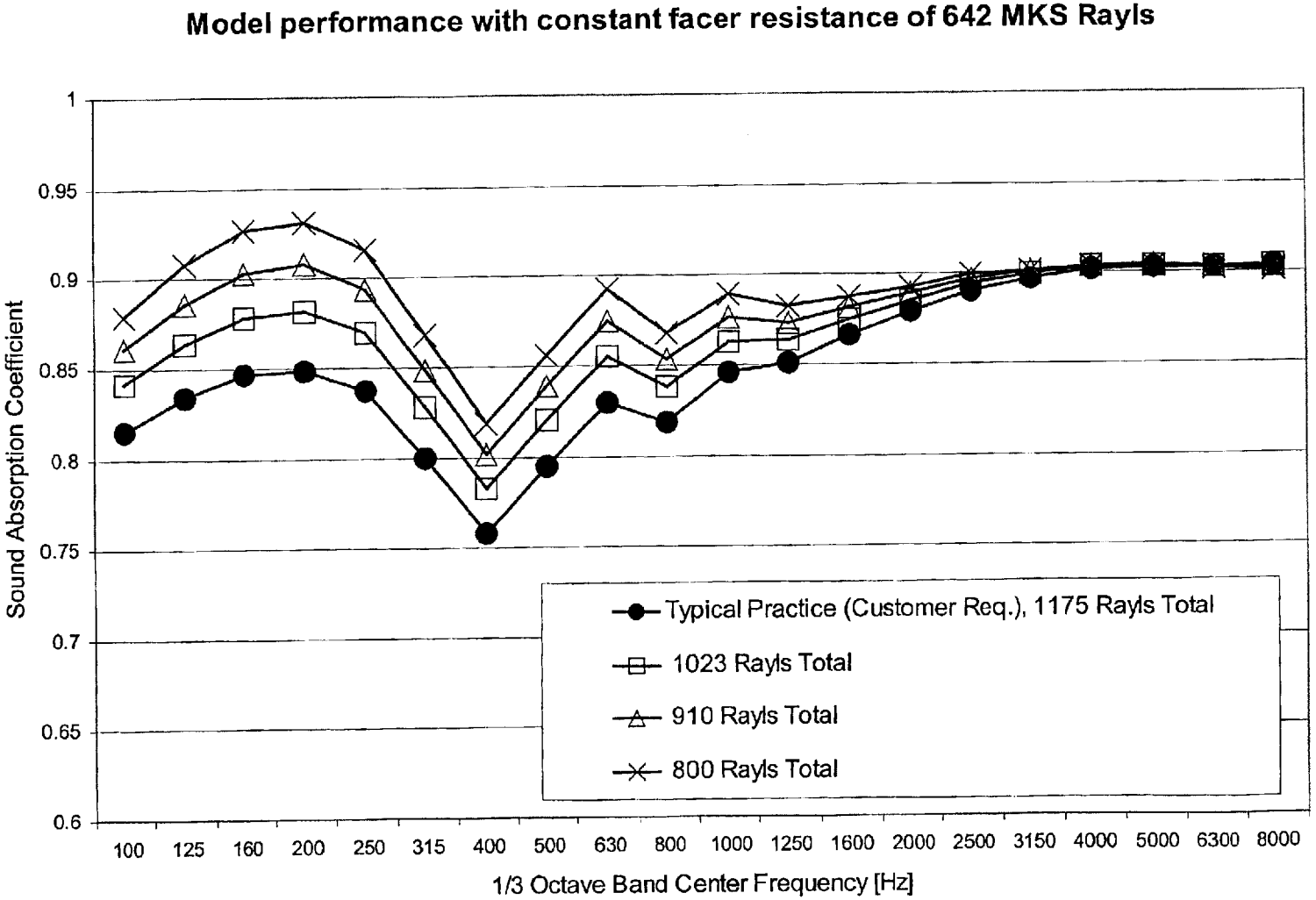
FIG. 2 illustrates determined sound absorption coefficients for three samples of differing total resistance and constant facer resistance.

FIG. 2 represents the modeled results of several system configurations with a constant sample thickness and constant facer resistance of 650 MKS Rayls, but differing total system resistances. The range of presumed systems is from 800 to 1200 Rayls. As shown, the range from 100 to 400 Hz is profoundly affected in terms of sound absorption (and therefore NRC) by a reduction in total resistance, with smaller improvements seen as high as 2500 Hz.

Figure 3:
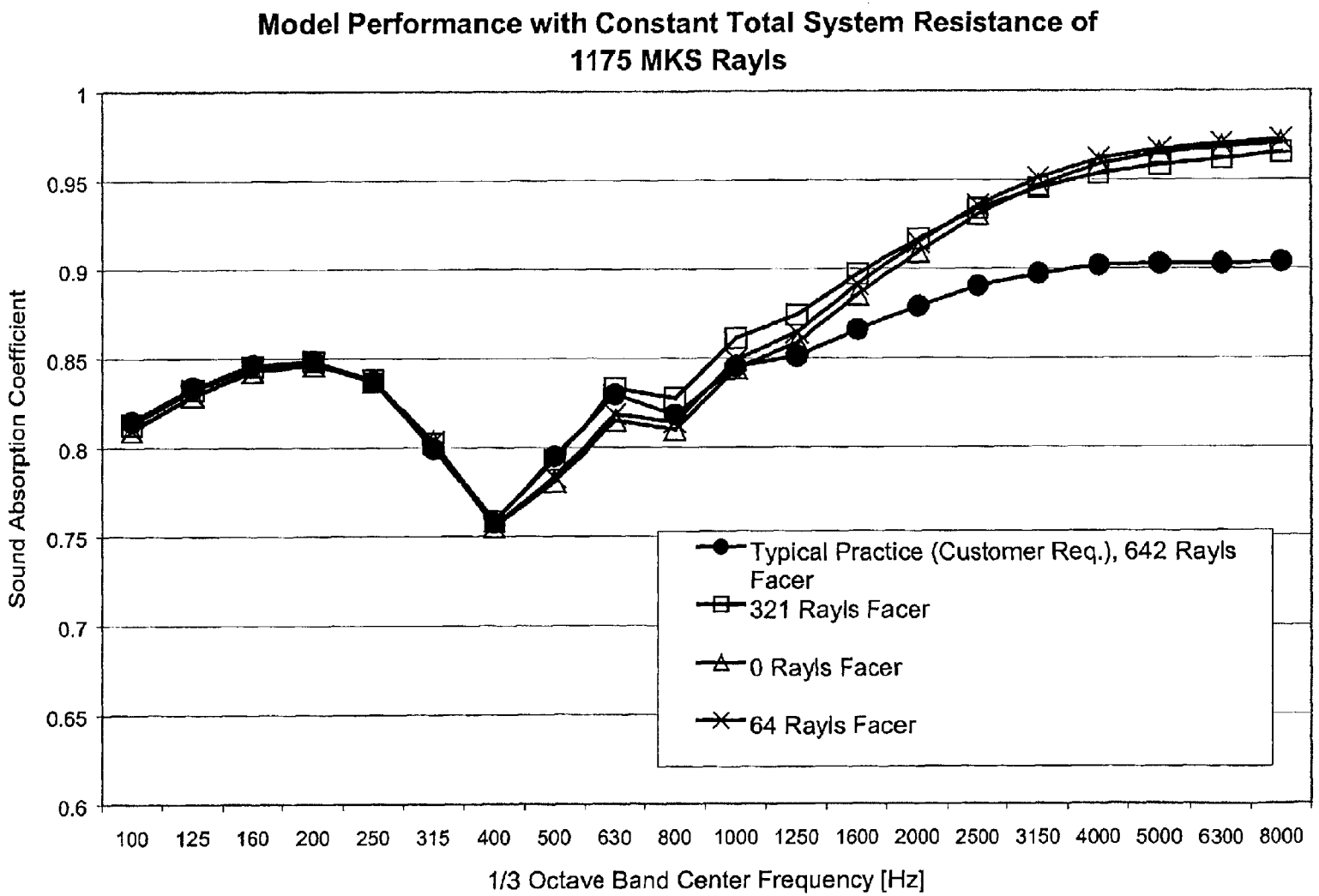
FIG. 3 illustrates determined sound absorption coefficients for three samples of differing facer resistance and constant total resistance.

In FIG. 3, the resistance of facing material 104 is manipulated while system resistance is held constant at 1200 Rayls. In this graph we see that there is no effect relating to sound absorption at 400 Hz and below, and that the greatest changes occur from 1250 Hz and above. Facing materials with high flow resistances begin to act as reflectors rather than transparent membranes due to their high acoustical impedance and to the impedance mismatching at the air/facer interface. This mismatching results from the difference between the impedance of air and the impedance of facing material 104.

Figure 4:
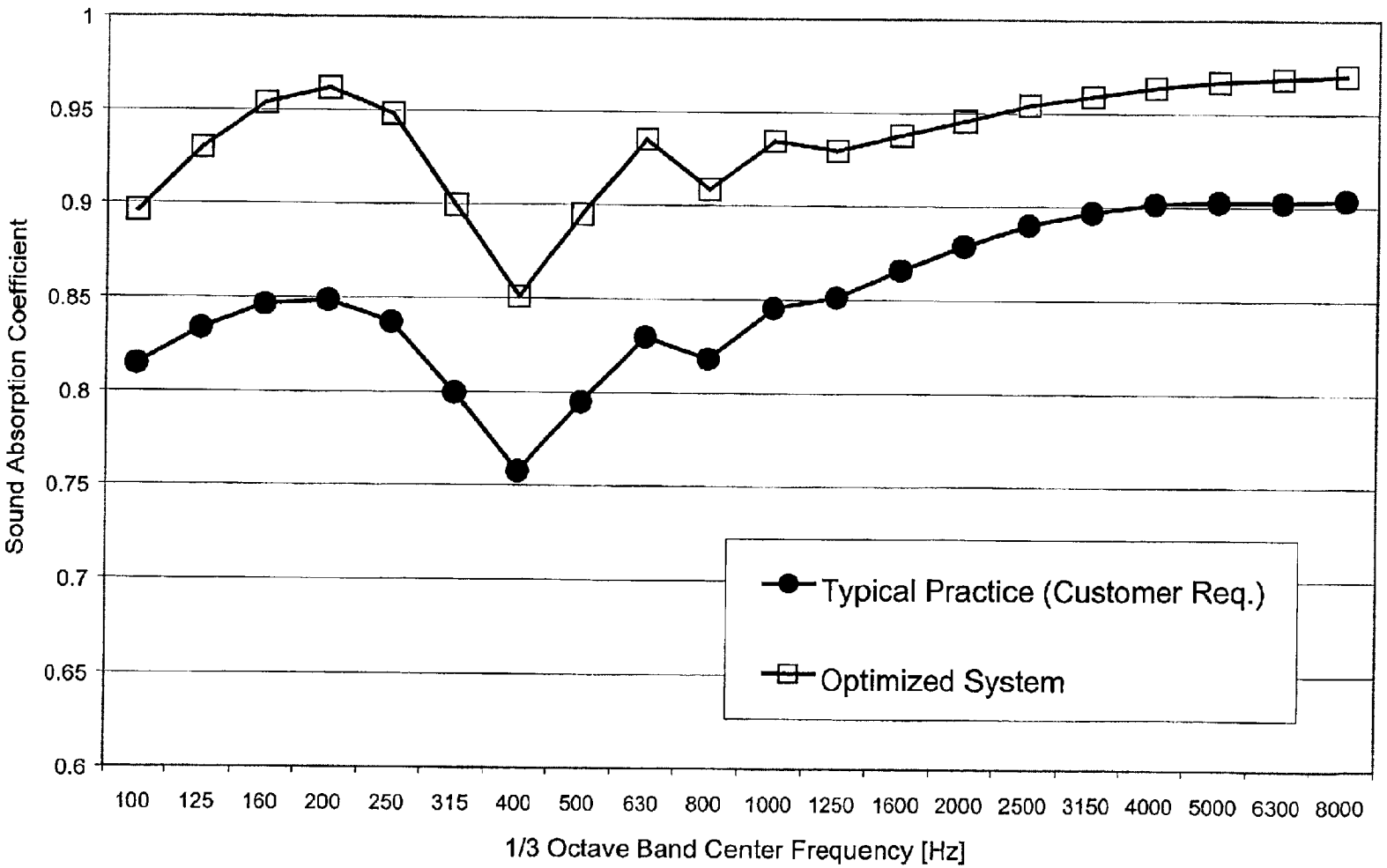
FIG. 4 illustrates determined sound absorption coefficients for two samples of differing facer resistance and differing total resistance in accordance with an exemplary embodiment of the present invention.

To design for better acoustical performance using the ideas presented herein, an optimal tile system 100 would have a very low total resistance relative to what is currently used. For example, a relatively low total system resistance can be around between 900 to 1300 MKS Rayls. An optimal system would also have a facing material 104 with a very low resistance relative to what is currently used. For example, a relatively low facer resistance can range from around 100 to 500 MKS Rayls. FIG. 4 illustrates the sound absorption coefficients of an exemplary embodiment of the present invention, where the modeled performance of an Optimized System includes facing material 104 of 325 Rayls resistance and substrate 102 of 325 Rayls resistance, yielding a total system resistance of 650 MKS Rayls. The Improved System includes facing material 104 of 650 Rayls resistance and substrate 102 of 550 Rayls resistance, yielding a total system resistance of 1200 MKS Rayls.

The NRC results of both analytical models should be adjusted up by 0.10 to represent measured test data for an equivalent ceiling system. Accordingly, the sample designated Improved System has an NRC of 0.839 (0.95 test result), while the Optimized System example has an NRC of 0.931 (1.05 test result), both of which offer acoustical performances higher than a conventional ceiling tile system. Indeed, further tests have verified these experimental results.

In this way, with total system resistances and facer air flow resistances of relatively low values, the exemplary embodiments of the present invention provide a simple and cost effective ceiling tile system for sound absorption, without requiring numerous additional calculations, or difficult manufacturing techniques.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A system for improved sound absorption, comprising:

a substrate of porous insulation material and of a first air flow resistance; and a facing material attached to the substrate and of a second air flow resistance, wherein a total system resistance is a combination of the first and second air flow resistances, the second air flow resistance is a relatively low value of around 100 to 500 MKS Rayls and the total system airflow resistance is around 900 to 1300 MKS Rayls.

2. The system of claim 1, wherein the substrate is made of one of glass fiber, thermoplastic polymeric fiber, thermosetting polymeric fiber, carbonaceous fiber, milkweed fiber, and foam insulation.

3. The system of claim 1, wherein the substrate is a ceiling tile.

4. The system of claim 1, comprising:

a second facing material attached to the substrate.

5. The system of claim 4, wherein the facing material and the second facing material form two opposite exterior surfaces of the system for improved sound absorption.

* * * * *